US007861783B2

(12) United States Patent
Baaijens et al.

(10) Patent No.: US 7,861,783 B2
(45) Date of Patent: Jan. 4, 2011

(54) METHOD FOR ADAPTING A TUBULAR ELEMENT IN A SUBSIDING WELLBORE

(75) Inventors: Matheus Norbertus Baaijens, GS Rijswijk (NL); Wilhelmus Christianus Maria Lohbeck, NG Nootdorp (NL); Paul Dirk Schilte, GD Rijswijk (NL)

(73) Assignee: Shell Oil Company, Houston, TX (US)

( * ) Notice: Subject to any disclaimer, the term of this patent is extended or adjusted under 35 U.S.C. 154(b) by 422 days.

(21) Appl. No.: 11/792,574

(22) PCT Filed: Dec. 8, 2005

(86) PCT No.: PCT/EP2005/056597

§ 371 (c)(1),
(2), (4) Date: Oct. 16, 2007

(87) PCT Pub. No.: WO2006/061410

PCT Pub. Date: Jun. 15, 2006

(65) Prior Publication Data

US 2008/0105431 A1 May 8, 2008

(30) Foreign Application Priority Data

Dec. 10, 2004 (EP) ..... 04257703

(51) Int. Cl.
*E21B 29/10* (2006.01)

(52) U.S. Cl. ..... 166/297; 166/384; 166/55; 166/55.8

(58) Field of Classification Search ..... 166/277, 166/297, 298, 381, 384, 55, 55.8
See application file for complete search history.

(56) References Cited

U.S. PATENT DOCUMENTS

| | | | | |
|---|---|---|---|---|
| 3,020,962 | A | 2/1962 | Holmquist | 166/242 |
| 5,174,340 | A | 12/1992 | Peterson et al. | 138/110 |
| 5,275,240 | A | 1/1994 | Peterson et al. | 166/242 |
| 6,409,226 | B1 | 6/2002 | Slack et al. | 285/226 |
| 6,446,323 | B1 | 9/2002 | Metcalfe et al. | 29/523 |
| 2003/0217844 | A1 | 11/2003 | Moyes | 166/118 |

FOREIGN PATENT DOCUMENTS

| | | |
|---|---|---|
| EP | 852282 | 8/1998 |
| WO | WO2004005669 | 1/2004 |
| WO | WO2004097170 | 11/2004 |

*Primary Examiner*—William P Neuder
*Assistant Examiner*—Brad Harcourt

(57) ABSTRACT

A method for adapting a tubular element extending into a wellbore formed in an earth formation, where the tubular element is susceptible to damage caused by axially compressive forces acting on the tubular element as a result of compaction of the earth formation surrounding the tubular element. The method comprises the steps of reducing the axial stiffness of at least one section of the tubular element, and allowing each tubular element section of reduced axial stiffness to be axially compressed by the action of said axially compressive forces, thereby accommodating compaction of the earth formation surrounding the tubular element.

11 Claims, 2 Drawing Sheets

METHOD FOR ADAPTING A TUBULAR ELEMENT IN A SUBSIDING WELLBORE

PRIORITY CLAIM

The present application claims priority from European Patent Application 04257703.1 filed 10 Dec. 2004.

The present invention relates to a method of adapting a tubular element extending into a wellbore formed in an earth formation, the tubular element being susceptible of damage due to axially compressive forces acting on the tubular element due to compaction of the earth formation surrounding the tubular element.

BACKGROUND OF THE INVENTION

In production operations for the production of hydrocarbon fluid from an earth formation it is common practice to install one or more steel tubular casings and/or liners in the wellbore to provide stability to the wellbore and to prevent undesired fluid migration through the wellbore. For ease of reference, in the description and claims hereinafter the term "casing" is used throughout to indicate either a wellbore casing or a wellbore liner. Generally each casing is fixedly arranged in the wellbore by means a layer of cement between the casing and the wellbore wall. In most applications the wellbore passes through an overburden layer, and extends into a reservoir zone of the earth formation.

Formation compaction normally occurs in the reservoir zone due to continued production of fluid therefrom, and virtually not in non-producing formations. Such compaction potentially leads to buckling or kinking of the wellbore casing, particularly if the reduction in length must be accommodated in a relatively short section of the casing. This can happen if, for example, the cement layer around the casing is of poor quality, or if there is a free section of casing between the top of the cement layer and a casing hanger for suspending the casing. If, for example, a compaction of 5 m occurs in a reservoir zone of 100 m thickness (i.e. 5% compaction), and such compaction has to be accommodated by 20 m of casing, then the casing is locally subjected to a deformation of 25%. Such large local deformation easily results in buckling or kinking of the casing. Another example relates to a situation whereby an oil well passes through a gas reservoir zone overlaying the oil reservoir zone, whereby compaction of the gas reservoir zone potentially causes collapse of the oil well casing.

More generally, if the wellbore not only passes through a non-compacting overburden layer but also through a compacting rock layer, a significant portion of the casing is potentially subjected to compressive loading. Such compressive loading increases with time as the thickness of the compacting layer reduces. The casing therefore can become damaged, for example by local buckling. The risk of damage is relatively high if a long casing section extends into a compacting formation, and/or if the casing has been poorly cemented in the wellbore.

SUMMARY OF THE INVENTION

In accordance with the invention there is provided a method of adapting a tubular element extending into a wellbore formed in an earth formation, the tubular element being susceptible of damage due to axially compressive forces acting on the tubular element due to compaction of the earth formation surrounding the tubular element, the method comprising:

reducing the axial stiffness of at least one section of the tubular element;

allowing each tubular element section of reduced axial stiffness to be axially compressed by the action of said axially compressive forces thereby accommodating compaction of the earth formation surrounding the tubular element.

BRIEF DESCRIPTION OF DRAWINGS

The invention will be described hereinafter in more detail by way of example, with reference to the accompanying drawings in which.

DETAILED DESCRIPTION OF THE INVENTION

Figure 1:
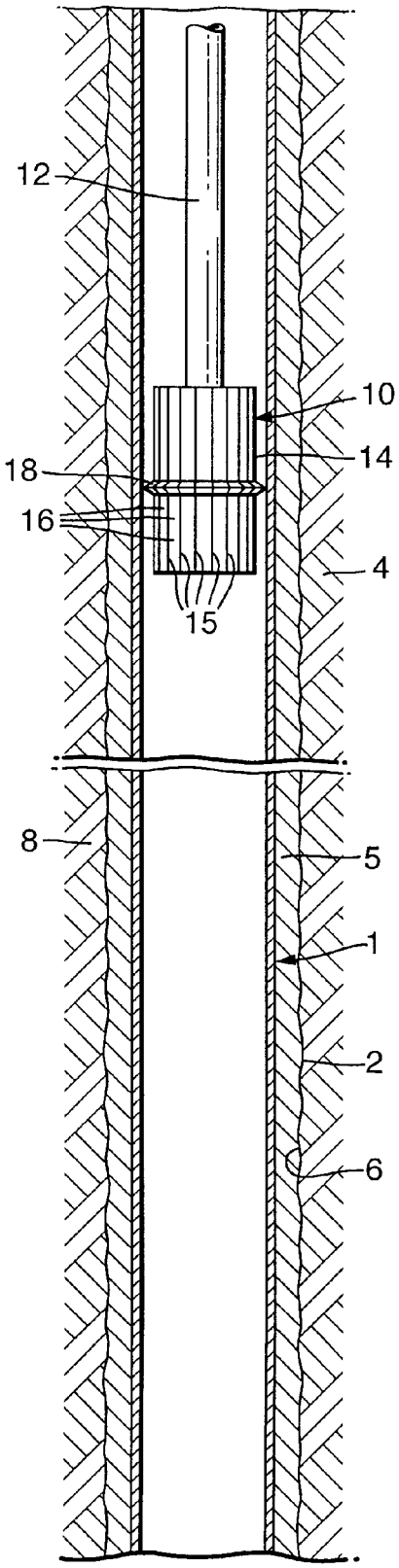
FIG. 1 schematically shows a longitudinal section of an embodiment of a wellbore casing to be adapted according to the method of the invention.

In the Figures like reference numerals relate to like components.

Referring to FIG. 1 there is shown a casing 1 extending into a wellbore 2 formed in an earth formation 4. The casing 1 is fixedly arranged in the wellbore 2 by a layer of cement 5 between the casing and the wellbore wall 6. The earth formation 4 includes a hydrocarbon oil containing layer (not shown), a hydrocarbon gas containing layer 8 above the hydrocarbon oil containing layer, and an overburden layer (not shown) above the hydrocarbon gas containing layer 8. The wellbore 2 passes through the overburden layer, the gas containing layer 8, and extends into the oil containing layer. Furthermore, the gas containing layer 8 is a porous rock formation of relatively low strength and is therefore susceptible of vertical compaction when the gas pressure in the hydrocarbon gas containing layer 8 decreases after continued production of gas from the gas containing layer 8.

An expansion tool 10 is suspended from surface in the wellbore 2 by means of a tubular string 12. The expansion tool 10 includes an expandable cylindrical outer member 14 and inflatable member (not shown) arranged within the cylindrical outer member 14. The cylindrical outer member 14 is provided with a plurality of slits 15 extending in longitudinal direction and being spaced along the circumference of the outer member 14. The slits 15 define a plurality of segments 16, whereby each segment 16 is located between two adjacent slits 15, the segments 16 being movable in radially outward direction by inflation of the inflatable member. The slits 15 do no extend the full length of the cylindrical member 14, therefore radially outward movement of the segments 16 induces elastic forces in the cylindrical member tending to move the segments 16 back to their original (unexpanded) position.

The inflatable member is arranged so as to be inflated by the action of fluid pressure supplied from surface through the tubular string 12. The cylindrical outer member 14 is integrally provided with an annular rim 18 extending radially outward from the cylindrical outer member 14.

Figure 2:
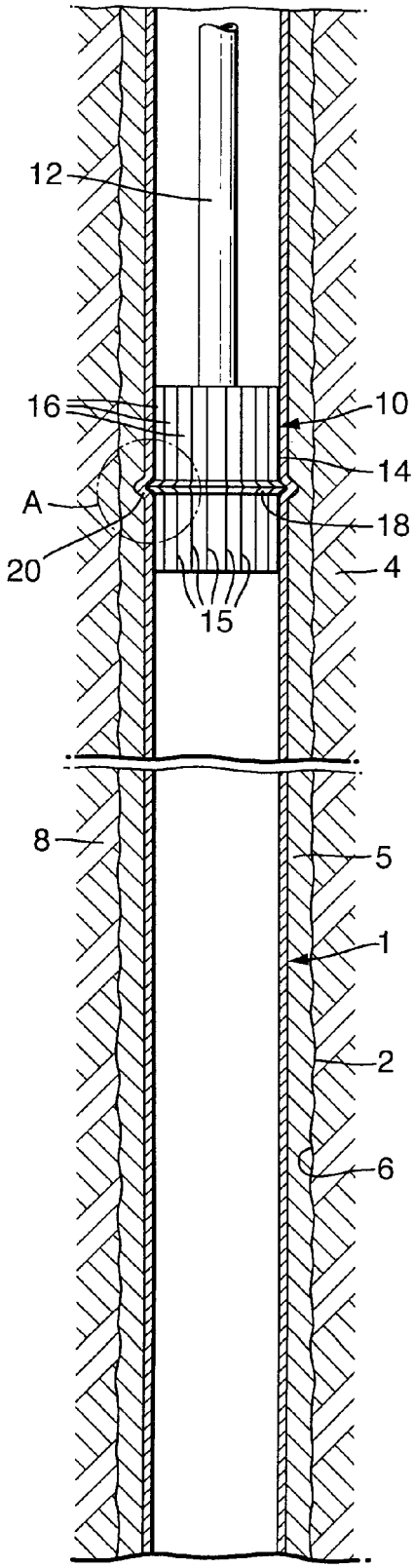
FIG. 2 schematically shows the wellbore casing of FIG. 1 after being adapted according to the method of the invention.
Figure 3:
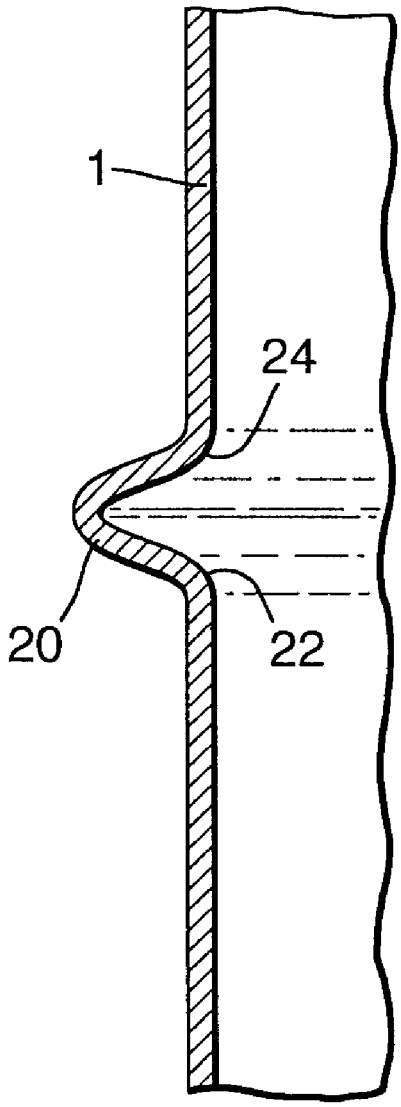
FIG. 3 schematically shows detail A of FIG. 2 before axial shortening of the casing.

Referring to FIGS. 2 and 3 there is shown the casing 1 after a section 20 of the casing 1 has been radially expanded by operation of the expansion tool 10. The radially expanded section 20 is rim-shaped and includes two opposite end portions 22, 24 arranged at an axial spacing relative each other.

Figure 4:
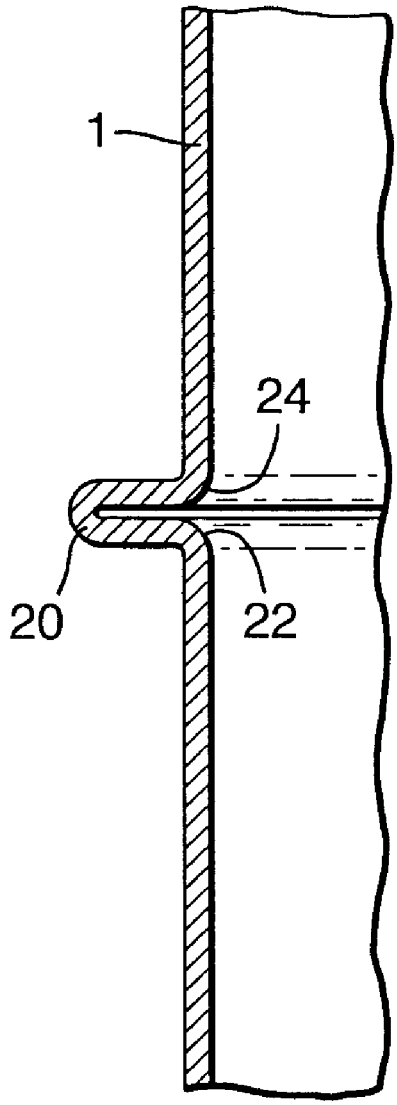
FIG. 4 schematically shows detail A of FIG. 2 after axial shortening of the casing.

Referring to FIG. 4 there is shown the radially expanded casing section 20 after axial shortening of the casing 1 due to compaction of the earth formation, whereby the opposite end portions 22, 24 are in contact with each other.

During normal operation the wellbore is operated to produce oil form the hydrocarbon oil containing layer by means of a conventional production tubing (not shown) extending from surface, through the casing 1, to the hydrocarbon oil containing layer. Simultaneously, gas is produced from the hydrocarbon gas containing layer 8, either via the wellbore 2 or via another wellbore (not shown). As a result of continued gas production from the layer 8 for a prolonged period of time, the fluid pressure in the layer 8 decreases and the effective stresses in the porous rock formation of the layer 8 increase. Such increased effective stresses eventually lead to gradual compaction of the layer 8 and corresponding subsidence of the overburden layer. Thus the wellbore 2 effectively shortens over time and the casing 1, which is fixedly connected to the wellbore wall by the layer of cement 5, becomes exposed to an increasing compressive force due to such shortening.

Once it becomes apparent that the earth formation 4 is susceptible to compaction, or even before such compaction becomes apparent, the production tubing is removed from the wellbore 2 and the expansion tool 10 is lowered through the casing 1 to the desired location. Fluid is then pumped via the tubular string 12, into the inflatable member. The longitudinal segments 16 thereby move radially outward whereby the cylindrical member 14 radially expands. The annular rim 8 of the expansion tool 10 thereby presses against the wall of the casing at a high force and thereby plastically deforms the casing 1 to form the rim-shaped casing section 20. The inflatable member is then deflated by relieving the fluid pressure from the inflatable member, so that the longitudinal segments 16 spring back to their original (unexpanded) position. The expansion tool is then moved in axial direction through the casing 1 to another position where it is desirable to form a further rim-shaped section 20. The process described above is then repeated as many times as necessary until the casing is provided with a selected number of further rim-shaped sections 20 regularly spaced along the casing, or along a portion thereof which is susceptible to axial compression due to compaction of the earth formation.

Each rim-shaped casing section 20 has a reduced axial stiffness compared to the remainder of the casing, by virtue of the rim-shaped section 20 being susceptible to bending if exposed to an axially compressive force exceeding a threshold value. Thus, upon the axial compressive force in the casing 1 exceeding the threshold value, the rim-shaped casing section 20 bends whereby the casing 1 effectively shortens. Bending of the rim-shaped section 20 stops when the end portions 22 of the rim-shaped section 20 become in abutment with each other (FIG. 4). In this manner it is achieved that the casing 1 accommodates axial shortening of the wellbore 2 due to compaction of the layer 8, in a controlled manner and without damage to the casing.

Suitably the rim-shaped casing sections are axially spaced at mutual spacings of between 0.1-0.3 meter, and preferably at mutual spacings of about 0.15 meter.

By reducing the axial stiffness of each said tubular element section, the tubular element is allowed to axially shorten in a controlled manner whereby the axially compressive forces acting on the tubular element due to compaction of the surrounding formation, are relieved.

In a suitable application of the method of the invention, the earth formation includes a hydrocarbon fluid containing layer susceptible of vertical compaction upon production of hydrocarbon fluid from said layer, and whereby after the step of reducing the axial stiffness of each said tubular element section, hydrocarbon fluid is produced from said layer.

The method of the invention is particularly useful in case said hydrocarbon fluid containing layer is an upper layer, and the earth formation further includes a lower hydrocarbon fluid containing layer, the wellbore passing through said upper layer and extending into said lower layer.

Preferably the step of reducing the axial stiffness of said tubular element section comprises radially deforming the tubular element section, for example by radially deforming the tubular element section so as to form a rim-shaped tubular element section extending radially outward from a remainder portion of the tubular element. Such rim-shaped tubular element section has the further advantage of increasing the collapse resistance. A suitable tool for creating such rim-shaped section is the expansion tool disclosed in WO 2004/097170, but with the modification that the outer surface of the tool is provided with an annular rim, the rim being formed of a plurality rim segments, each rim segment being integrally formed with a respective one of the longitudinal segments of the tool.

We claim:

1. A method of adapting a tubular element extending into a wellbore formed in an earth formation, the tubular element being susceptible of damage due to axially compressive forces acting on the tubular element due to compaction of the earth formation surrounding the tubular element, the method comprising:

producing hydrocarbon fluid from the earth formation;

reducing the axial stiffness of at least one section of the tubular element after the tubular element becomes exposed to axially compressive forces due to compaction of the earth formation as a result of said production of hydrocarbon fluid; and allowing each tubular element section of reduced axial stiffness to be axially compressed by the action of said axially compressive forces thereby accommodating compaction of the earth formation surrounding the tubular element.

2. The method of claim 1, wherein the earth formation includes a hydrocarbon fluid containing layer susceptible of vertical compaction upon production of hydrocarbon fluid from said layer, and wherein the method further comprises, after the step of reducing the axial stiffness of each said tubular element section, producing hydrocarbon fluid from said layer.

3. The method of claim 2, wherein said hydrocarbon fluid containing layer is an upper layer, and wherein the earth formation further includes a lower hydrocarbon fluid containing layer, the wellbore passing through said upper layer and extending into said lower layer.

4. The method of claim 1, wherein the step of reducing the axial stiffness of said tubular element section comprises radially deforming the tubular element section.

5. The method of claim 4, wherein said tubular element section is radially deformed so as to form a rim-shaped tubular element section extending radially outward from a remainder portion of the tubular element.

6. The method of claim 5, wherein said rim-shaped tubular element section comprises opposite end portions arranged at an axial spacing relative to each other, and wherein said axial spacing reduces during axial compression of the rim-shaped tubular element section by the action of said axially compressive forces.

7. The method of claim 6, wherein said opposite end portions are in contact with each other after axial compression of the rim-shaped tubular element section by the action of said axially compressive forces.

8. The method of claim 1, wherein the step of reducing the axial stiffness of at least one section of the tubular element comprises reducing the axial stiffness of a plurality of said tubular element sections axially spaced along the tubular element.

9. The method of claim 1, wherein the step of reducing the axial stiffness of at least one section of the tubular element comprises arranging a radially expandable tool in the tubular element and expanding said tool so as to radially expand each said section of the tubular element.

10. The method of claim 9, wherein said radially expandable tool includes a plurality of radially expandable segments spaced along the circumference of the tool.

11. The method of claim 1, wherein the tubular element is fixedly arranged in the wellbore by a layer of cement located between the tubular element and the wellbore wall.

* * * * *